US006457399B1

(12) United States Patent
Jingu

(10) Patent No.: US 6,457,399 B1
(45) Date of Patent: Oct. 1, 2002

(54) SWASH PLATE TYPE COMPRESSOR IN WHICH A SWASH PLATE HAS AN AXIAL END MADE OF BRONZE-BASED METAL

(75) Inventor: Naoki Jingu, Gunma (JP)

(73) Assignee: Sanden Corporation, Gunma (JP)

( * ) Notice: Subject to any disclaimer, the term of this patent is extended or adjusted under 35 U.S.C. 154(b) by 40 days.

(21) Appl. No.: 09/704,799

(22) Filed: Nov. 3, 2000

(30) Foreign Application Priority Data

Nov. 4, 1999 (JP) ..... 11-314361

(51) Int. Cl.[7] ..... F01B 3/00
(52) U.S. Cl. ..... 92/71; 92/155
(58) Field of Search ..... 92/71, 155; 74/60

(56) References Cited

U.S. PATENT DOCUMENTS

| | | | | |
|---|---|---|---|---|
| 2,709,339 A | | 5/1955 | Edelman et al. | |
| 4,037,522 A | | 7/1977 | Inoshita et al. | |
| 4,244,679 A | | 1/1981 | Nakayama et al. | |
| 4,664,604 A | | 5/1987 | Terauchi | |
| 5,056,417 A | | 10/1991 | Kato et al. | |
| 5,382,139 A | | 1/1995 | Kawaguchi et al. | |
| 5,875,702 A | * | 3/1999 | Kawagoe et al. | 92/12.2 |
| 5,974,946 A | | 11/1999 | Kanou et al. | |

FOREIGN PATENT DOCUMENTS

| | | |
|---|---|---|
| JP | 57028881 | 2/1982 |
| JP | 02267371 | 11/1990 |
| JP | 03067069 | 3/1991 |
| JP | 08247021 | 9/1996 |

* cited by examiner

*Primary Examiner*—Edward K. Look
*Assistant Examiner*—Michael Leslie
(74) *Attorney, Agent, or Firm*—Baker Botts, L.L.P.

(57) ABSTRACT

In a swash plate type compressor having a swash plate rotated by a drive shaft, the swash plate is made by attaching a bronze-based metal plate to a base plate. The bronze-based metal plate forms an axial end of the swash plate, along which a shoe slides when the drive shaft is driven is rotated. The shoe is held by a piston slidably inserted in a cylinder bore which is formed in a cylinder block. It is preferable that the base plate is made of iron.

9 Claims, 2 Drawing Sheets

SWASH PLATE TYPE COMPRESSOR IN WHICH A SWASH PLATE HAS AN AXIAL END MADE OF BRONZE-BASED METAL

BACKGROUND OF THE INVENTION

This invention relates to a swash plate type compressor.

Use is widely made of a swash plate type compressor comprising a cylinder block having a cylinder bore, a piston slidably received within the cylinder bore, a drive shaft, a swash plate mounted to the drive shaft in an inclined state, and a shoe interposed between the swash plate and the piston. The swash plate is rotated in synchronism with the rotation of the drive shaft. The rotation of the swash plate is converted via the shoe into a reciprocating motion of the piston in an extending direction of the drive shaft so that a fluid within the cylinder bore is compressed.

In a conventional swash plate type compressor, the swash plate is formed by a material which is excellent in lubricity, for example, a bronze plate, an aluminum alloy plate coated with a solid lubricant, an aluminum alloy plate having a tinned surface, an iron plate with a sprayed bronze coating, an iron plate coated with a solid lubricant, in order to improve the lubricity between the swash plate and the shoe which are brought into sliding contact.

In case where the swash plate is formed by the bronze plate, the aluminum alloy plate coated with a solid lubricant, or the aluminum alloy plate having a tinned surface, the swash plate must have an increased thickness in order to assure a sufficient strength. On the other hand, in case where the swash plate is formed by the iron plate with a sprayed bronze coating or the iron plate coated with a solid lubricant, a lubricant layer formed on the surface of the swash plate is readily detached.

SUMMARY OF THE INVENTION

It is therefore an object of this invention to provide a swash plate type compressor comprising a swash plate which assures a sufficient strength without increasing the thickness and which suppresses the detachment of a lubricant layer formed on its surface.

Other objects of the present invention will become clear as the description proceeds.

According to the present invention, there is provided a swash plate type compressor which comprises a cylinder block having a cylinder bore, a piston slidably inserted in the cylinder bore, and a drive shaft, a swash plate rotated by the drive shaft. The swash plate has a first and a second axial end opposite to each other and comprises a base plate and an attached plate attached integral with the base plate to form the first axial end. The attached plate is made of bronze-based metal. The swash plate type compressor further comprises a shoe held by the piston and slidable along the first axial end.

DESCRIPTION OF THE PREFERRED EMBODIMENT

Now, description will be made about a swash plate type compressor according to an embodiment of this invention.

Figure 1:
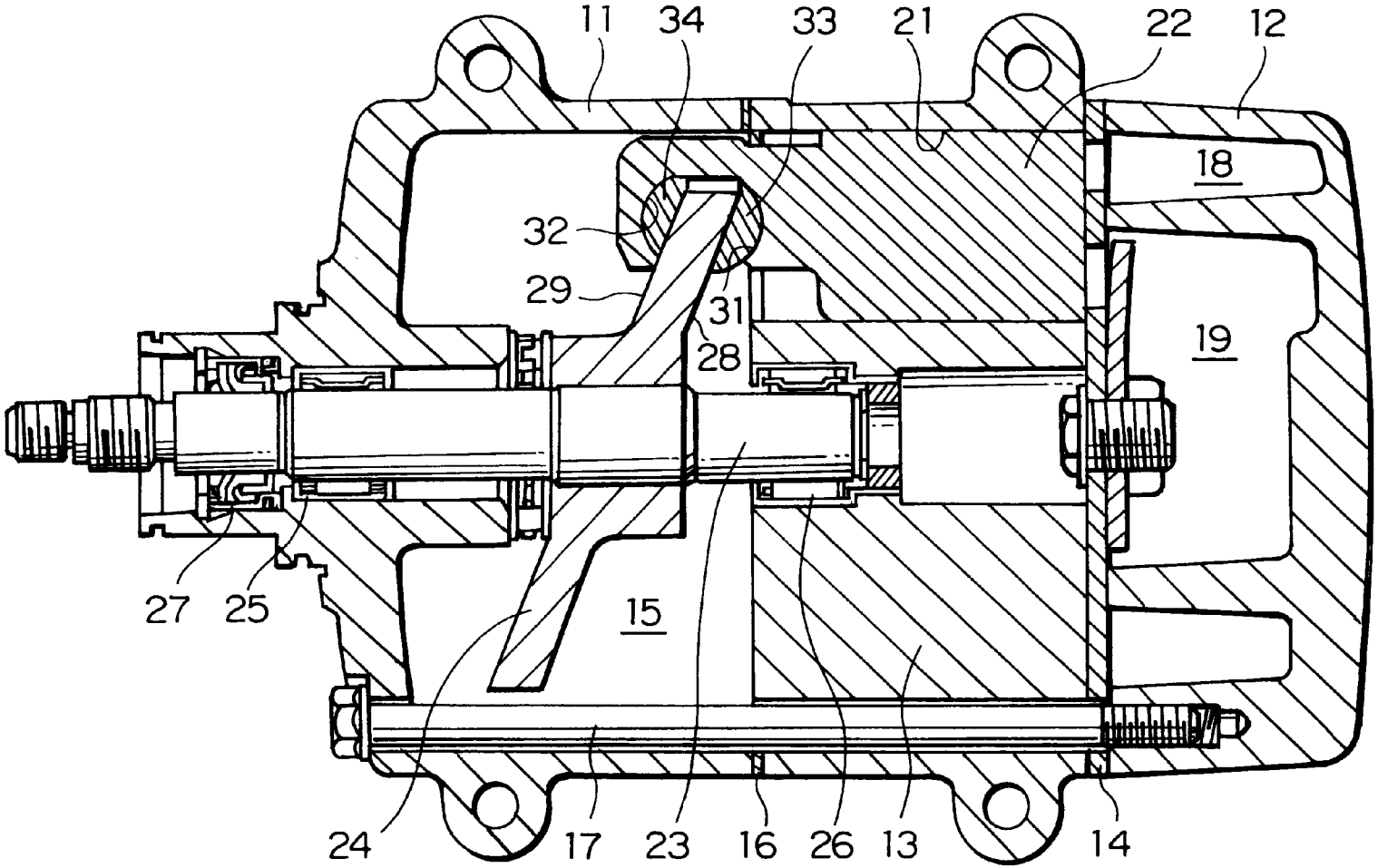
FIG. 1 is a side sectional view of a swash plate type compressor according to an embodiment of this invention.

Referring to FIG. 1, the swash plate type compressor comprises a front housing 11, a cylinder head 12, a cylinder block 13 placed between the front housing 11 and the cylinder head 12, and a valve assembly 14 interposed between the cylinder head 12 and the cylinder block 13. The front housing 11 defines a crank chamber 15 in cooperation with the cylinder block 13. A seal member 16 is inserted between the front housing 11 and the cylinder block 13 to seal the crank chamber 15. The front housing 11, a cylinder head 12, a cylinder block 13, and a valve assembly 14 are connected to each other by a plurality of bolt members (only one of which is depicted by a reference numeral 17).

The cylinder head 12 has a suction chamber 18 and a discharge chamber 19. The suction chamber 18 extends around the discharge chamber 19. In the manner known in the art, the suction chamber 18 and the discharge chamber 1 9d are connected to a suction port and a discharge port, respectively, which are not shown.

The cylinder block 13 has a plurality of cylinder bores (only one of which is depicted by a reference numeral 21) circularly arranged around a central axis of the compressor. Each of the cylinder bores 21 extends parallel to the central axis. A plurality of pistons (only one of which is depicted by a reference numeral 22) are slidably inserted in the cylinder bores 21, respectively, to compress a gaseous fluid when reciprocated in the cylinder bores 21. In the manner known in the art, the valve assembly 14 controls a flow of the gaseous fluid so that the gaseous fluid flows from the suction chamber 18 to the discharge chamber through the cylinder bores 21 in response to a reciprocating motion of each of the pistons 22.

The swash plate type compressor further comprises a drive shaft 23 extending along the central axis and a swash plate 24 mounted on the drive shaft 23 to make an angle therebetween. The drive shaft 23 penetrates the front housing 11 and rotatably supported by front and rear bearings 25 and 26 which are fixed to the front housing 11 and the cylinder block 13, respectively. A seal mechanism 27 is provided between the front housing 11 and the drive shaft 23 to seal the crank chamber 15. It is to be noted that the drive shaft 23 is prevented from movement thereof along the central axis in the manner known in the art.

The swash plate 24 is fixed to the drive shaft 23. In other words, the swash plate 24 is engaged with the drive shaft 23 in both of an axial direction and a rotation direction.

The swash plate 24 is in an inclined state relative to the drive shaft 23 and has a first axial end 28 and a second axial end 29 opposite to the first axial end 28 in the axial direction. Each of the first and the second axial ends 28 and 29 is flat.

Each of the pistons 22 has first and second recessed surfaces 31 and 32 which are opposite to the first and the second axial ends 28 and 29, respectively. Each of the first and the second recessed surfaces 31 and 32 is of a spherical shape.

The swash plate type compressor further comprises a first shoe 33 interposed between the first axial end 28 and the first recessed surface 31 and a second shoe 34 interposed between the second axial end 29 and the second recessed surface 32. The first and the second shoes 33 and 34 are held by each of the pistons 22 and are slidable along the first and the second axial ends, respectively.

In the swash plate type compressor mentioned above, the drive shaft 23 is driven and rotated by an external drive source (not shown). In synchronism with the rotation of the drive shaft 23, the swash plate 24 is rotated around the central axis. The rotation of the swash plate 24 is converted via the first and the second shoes 33 and 34 into the reciprocating motion of each of the pistons 22 in the axial direction so that the gaseous fluid is compressed within each of the cylinder bores 21.

Figure 2:
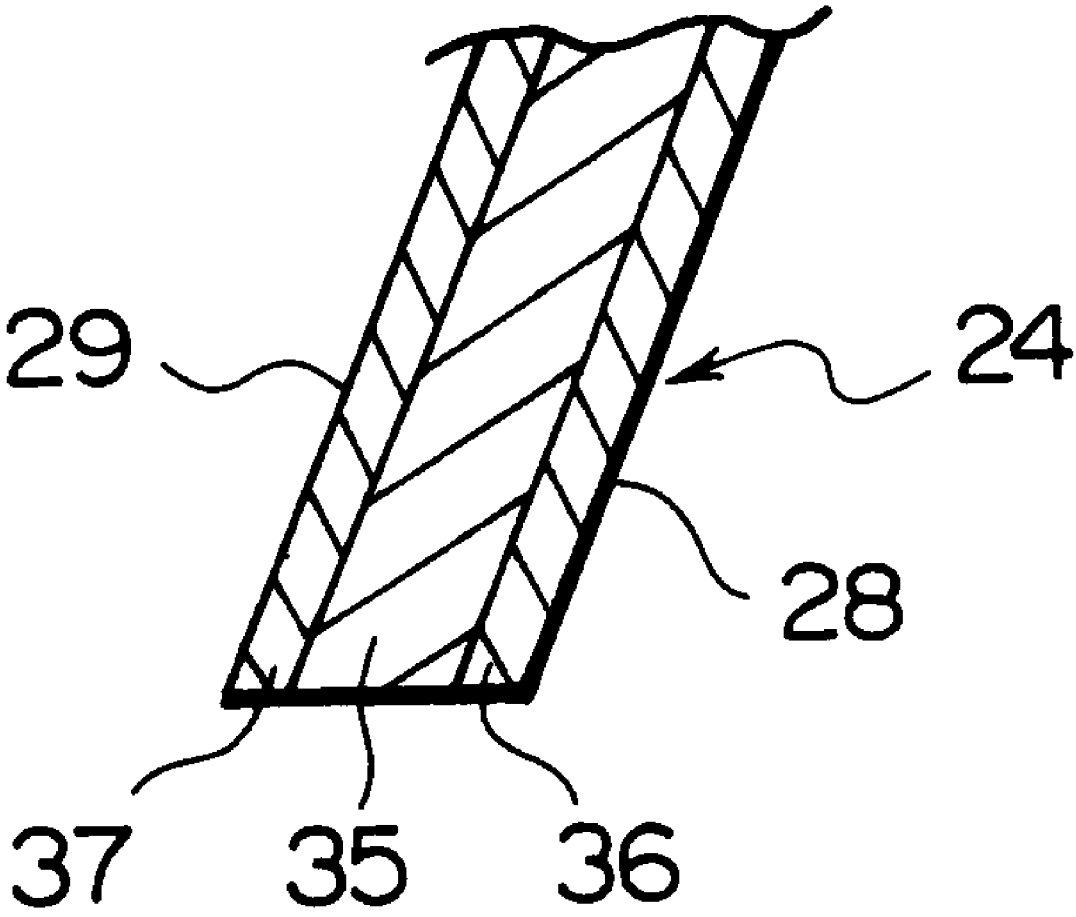
FIG. 2 is an enlarged sectional view of a swash plate included in the swash plate type compressor illustrated in FIG. 1.

Referring to FIG. 2, the swash plate 24 is formed by a cladding material comprising a base plate 35 of iron and first and second attached plates 36 and 37 attached integral with the base plate 35 to sandwich the base plate 35 in the axial direction. The first and second attached plates 36 and 37 form the first and the second axial ends 28 and 29, respectively. Each of the first and second attached plates 36 and 37 is made of bronze-based metal, for example, a copper alloy including tin. The content of tin is preferably equal to 15.8 wt % or less.

The cladding material can be produced by press-bonding a stack of the base plate 35 and the first and the second attached plates 36 and 37 by cold rolling and subsequently carrying out diffuse-annealing. In this manner, it is possible to obtain the cladding material having a sufficient bonding strength.

The swash plate 24 of such an integral structure assures a sufficient strength without increasing the thickness and suppresses the detachment of a lubricant layer formed on its surface. Thus, it is possible to provide the swash plate type compressor comprising the swash plate formed by the material which assures the sufficient strength without increasing the thickness and which suppresses the detachment of the lubricant layer formed on its surface.

While the present invention has thus far been described in connection with a single embodiment thereof, it will readily be possible for those skilled in the art to put this invention into practice in various other manners. For example, although the description have been made as regards the swash plate type compressor of a fixed displacement type, the present invention is also applicable to a swash plate type compressor of a variable displacement type in which a discharge volume is controllably varied by changing the angle of the swash plate with respect to the drive shaft.

What is claimed is:

1. A swash plate type compressor comprising:

a cylinder block having a cylinder bore;

a piston slidably inserted in said cylinder bore;

a drive shaft;

a swash plate rotated by said drive shaft, said swash plate having a first and a second axial end opposite each other and comprising a base plate, and an attached plate press bonded to, and attached integral with, said base plate to form said first axial end, said attached plate being made of bronze-based metal; and a shoe held by said piston and slidable along said first axial end.

2. A swash plate type compressor as claimed in claim 1, wherein said base plate is made of iron.

3. A swash plate type compressor as claimed in claim 1, further comprising an additional shoe held by said piston and slidable along said second axial end, said swash plate further comprising an additional attached plate attached integral with said base plate to form said second axial end.

4. A swash plate type compressor as claimed in claim 3, wherein said additional attached plate is made of bronze-based metal.

5. A swash plate type compressor as claimed in claim 1, wherein said swash plate is mounted on said drive shaft to make an angle therebetween and is engaged with said drive shaft in a rotation direction.

6. A swash plate type compressor as claimed in claim 5, wherein said angle is fixedly determined.

7. A swash plate type compressor as claimed in claim 5, wherein said angle is changeable.

8. A swash plate type compressor as claimed in claim 1, wherein said cylinder bore extends parallel to said drive shaft.

9. A swash plate type compressor comprising:

a cylinder block having a cylinder bore;

a piston slidably inserted in said cylinder bore;

a drive shaft;

a swash plate rotated by said drive shaft, said swash plate having a first and a second axial end opposite each other and comprising a base plate, a first attached plate attached integral with said base plate to form said first axial end, and a second attached plate attached integral with said base plate to form said second axial end, wherein said first attached plate and said second attached plate comprise a bronze-based metal;

a first shoe held by said piston and slidable along said first axial end; and a second shoe held by said piston and slidable along said second axial end.

* * * * *